US008279088B2

(12) United States Patent
Khim

(10) Patent No.: US 8,279,088 B2
(45) Date of Patent: Oct. 2, 2012

(54) SYSTEM FOR PARKING MANAGEMENT

(76) Inventor: Key-chang Khim, Seoul (KR)

( * ) Notice: Subject to any disclaimer, the term of this patent is extended or adjusted under 35 U.S.C. 154(b) by 564 days.

(21) Appl. No.: 12/086,052

(22) PCT Filed: Sep. 8, 2006

(86) PCT No.: PCT/KR2006/003586
§ 371 (c)(1),
(2), (4) Date: Jul. 30, 2009

(87) PCT Pub. No.: WO2007/066877
PCT Pub. Date: Jun. 14, 2007

(65) Prior Publication Data

US 2009/0303079 A1 Dec. 10, 2009

(30) Foreign Application Priority Data

Dec. 6, 2005 (KR) ..... 10-2005-0118058

(51) Int. Cl.
*G08G 1/14* (2006.01)

(52) U.S. Cl. ..... 340/932.2; 340/937; 705/5; 705/13

(58) Field of Classification Search ..... 340/932.2, 340/937; 705/5, 13; 348/148, 149; 382/105; 707/812
See application file for complete search history.

(56) References Cited

U.S. PATENT DOCUMENTS

| | | | | |
|---|---|---|---|---|
| 6,340,935 | B1 * | 1/2002 | Hall | 340/932.2 |
| 6,865,539 | B1 | 3/2005 | Pugliese, III | |
| 7,688,225 | B1 * | 3/2010 | Haynes et al. | 340/932.2 |
| 7,893,848 | B2 * | 2/2011 | Chew | 340/932.2 |
| 2004/0222903 | A1 | 11/2004 | Li | |
| 2007/0069921 | A1 * | 3/2007 | Sefton | 340/932.2 |
| 2008/0033769 | A1 * | 2/2008 | Koorapati et al. | 705/5 |

FOREIGN PATENT DOCUMENTS

| | | |
|---|---|---|
| CN | 1358145 | 7/2002 |
| CN | 1474298 | 2/2004 |
| JP | 2004-534332 | 11/2004 |
| JP | 2005-332005 | 12/2005 |
| KR | 10-2002-0085040 | 11/2002 |
| KR | 100384438 | 5/2003 |
| KR | 10-2004-0021745 | 3/2004 |
| KR | 10-2005-0013784 | 2/2005 |
| KR | 10-2005-0099403 | 10/2005 |

* cited by examiner

*Primary Examiner* — Brent Swarthout
(74) *Attorney, Agent, or Firm* — Christopher Paul Mitchell

(57) ABSTRACT

The present invention relates to a parking management system. The parking management system includes an entrance camera (100) installed at an entrance of a parking lot to photograph a vehicle that enters the parking lot. An exit camera (200) photographs a vehicle that departs from the parking lot. A plurality of region cameras (300) is installed in respective parking regions to photograph a vehicle. A management server (400) includes a vehicle license number recognition unit (450) for recognizing a vehicle license number, a registration unit (460) for registering a last photographed parking region on a parking ticket, a control unit (440) for calculating a number of available parking spaces for each parking region, and determining a total number of available parking spaces, and a guidance unit (470) for guiding an entering vehicle to an available parking region. A display unit (350) displays the number of available parking spaces.

6 Claims, 3 Drawing Sheets

[Fig. 1]
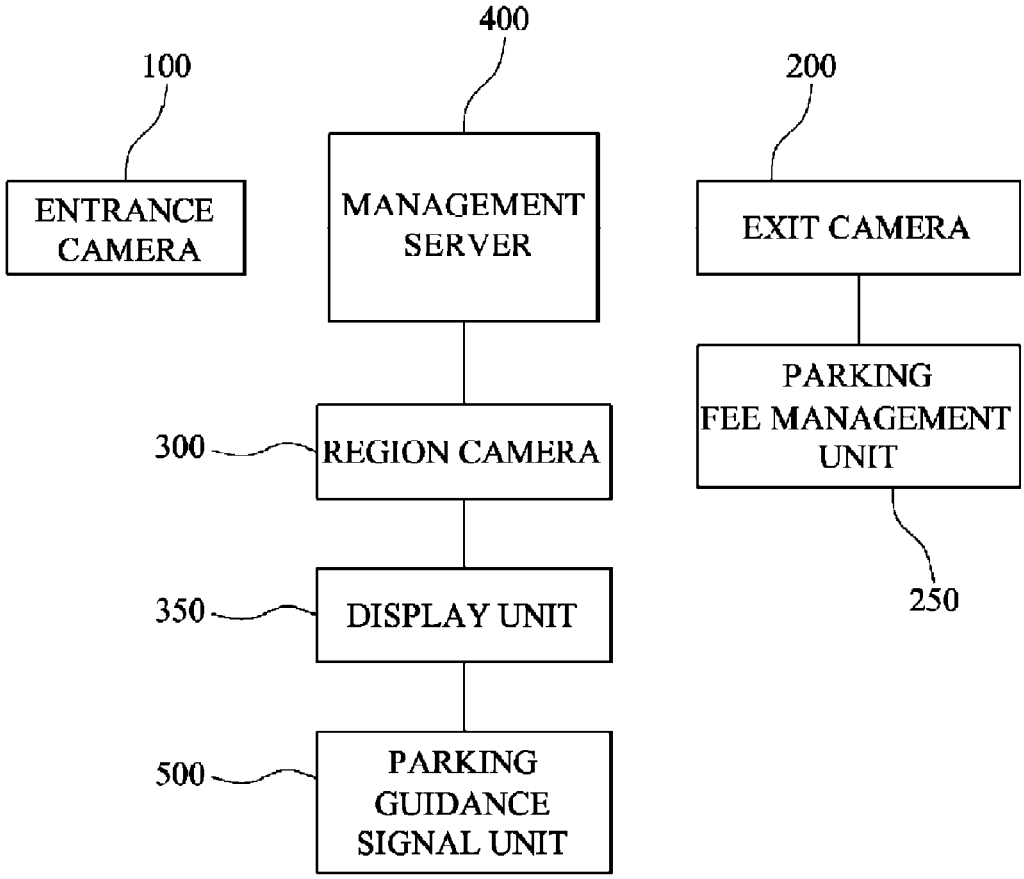
[Fig. 2]
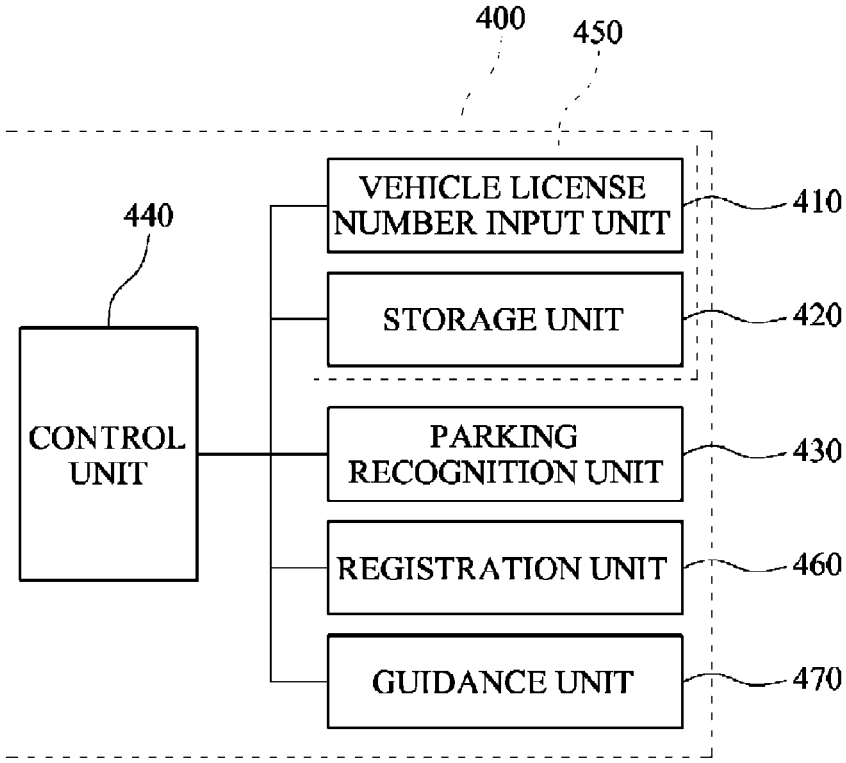

[Fig. 3]
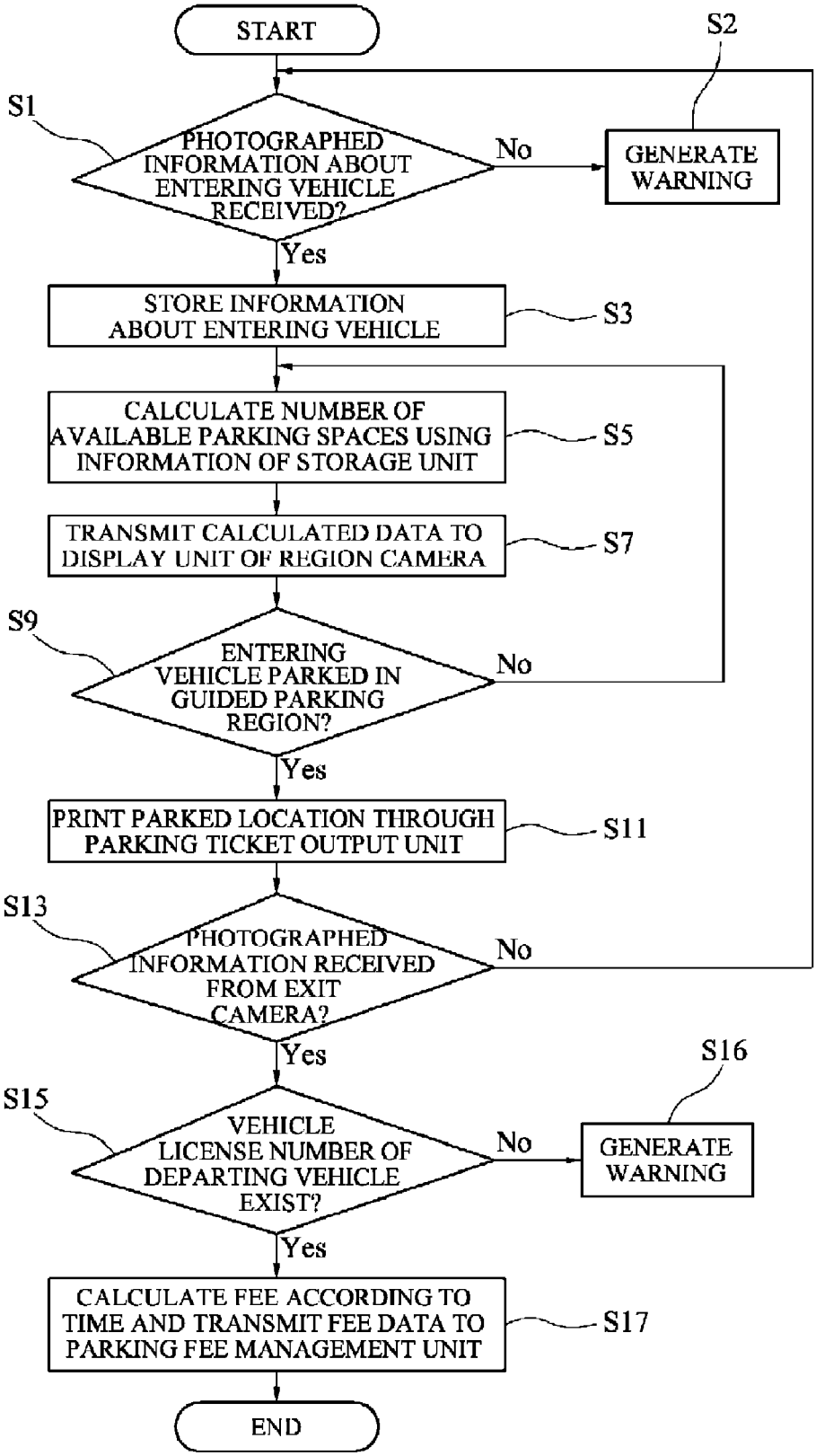

[Fig. 4]
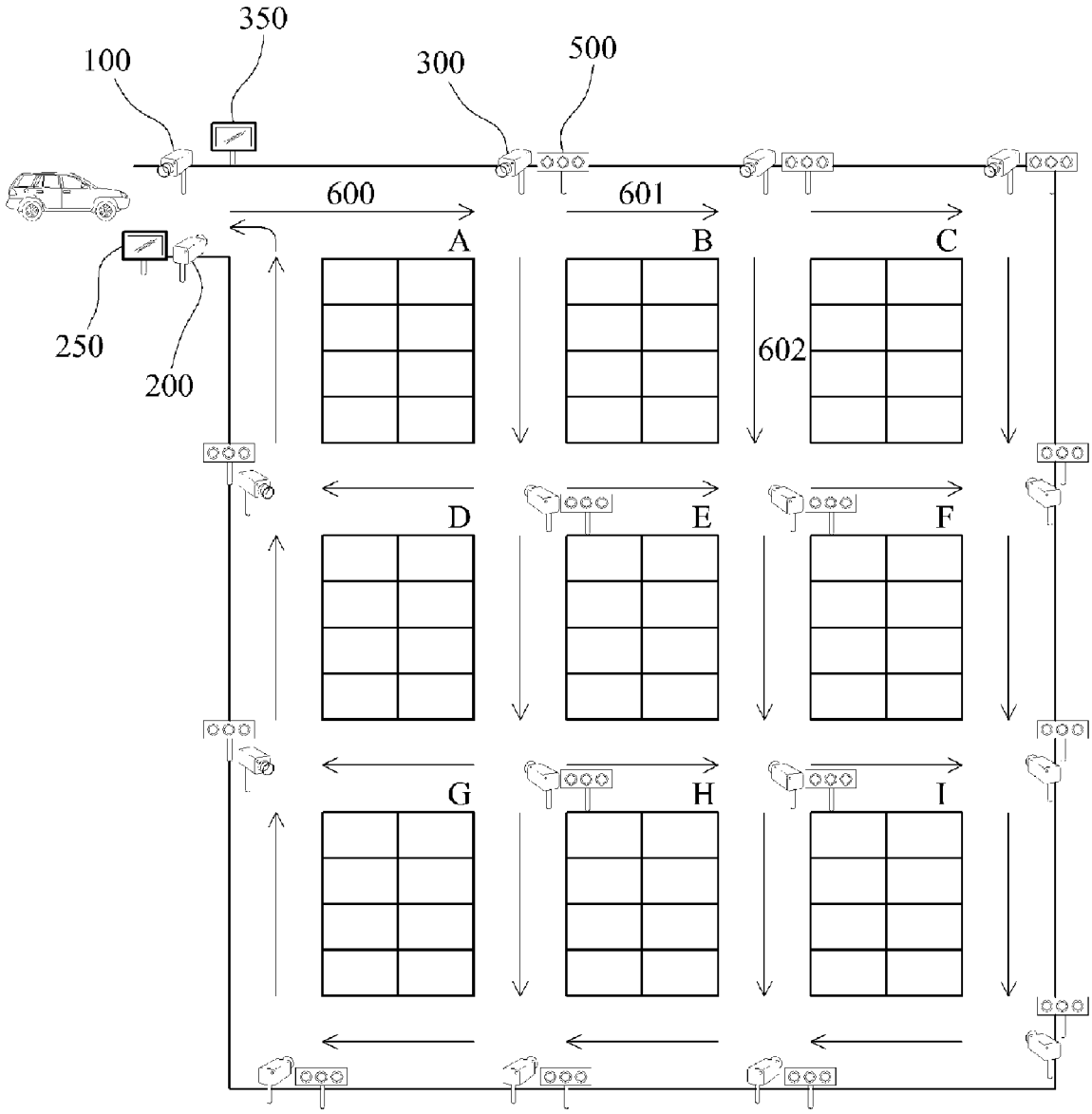

SYSTEM FOR PARKING MANAGEMENT

TECHNICAL FIELD

The present invention relates, in general, to a parking management system and, more particularly, to a parking management system, which determines the presence of a vehicle intended to be parked in a parking region in a large building or a large parking lot, and suitably guides the vehicle to a suitable parking region, thus helping the vehicle's driver easily find a parking space.

BACKGROUND ART

Generally, places which are crowded with many people, such as large department stores, shopping centers, theaters, and sports stadiums, are also crowded with many vehicles, thus there are difficulties in parking.

Therefore, a large parking lot or parking building is constructed in the central area of a city or in the region having increasing traffic, so that a plurality of vehicles can be parked together, thus solving the difficulty of parking.

However, in the case of the large parking lot or parking building, there are problems in that various difficulties in charging fees for parking arise, and efficient management of a plurality of parking spaces is not easily performed.

Further, a conventional parking management system still has problems related to high manpower costs, errors in manual recordkeeping by a manager, unauthorized parking, etc., and requires a lot of manpower and incurs a lot of expense to enter and calculate parking business data every day.

Further, from the standpoint of a user who uses a parking lot, the user wastes his or her time finding an available parking space, and undergoes difficulty in finding his or her vehicle when the user does not remember the location at which the vehicle is parked in a large parking lot.

In order to solve the above difficulty, a system designed such that vehicle sensing coils or vehicle sensors are installed in respective parking partitions and the entrance and exit of individual vehicles is monitored has been developed. However, there are problems in that, for such a system, high maintenance costs are required to install a plurality of sensors for sensing a plurality of vehicles, to construct communication lines for connecting to a management center, and to normally operate the sensors.

DISCLOSURE OF INVENTION

Technical Problem

Accordingly, the present invention has been made keeping in mind the above problems, and an object of the present invention is to provide a parking management system, which can allow a vehicle, entering a parking lot, to easily find an available parking space, can allow a driver to easily find the location at which his or her vehicle is parked, can keep tract of the total number of the available parking spaces, and can reduce parking time, through the use of an image recognition technique.

Technical Solution

In order to accomplish the above object, the present invention provides a parking management system, comprising an entrance camera (100) installed at an entrance of a parking lot, and adapted to photograph a vehicle that enters the parking lot; an exit camera (200) for photographing a vehicle that departs from the parking lot; a plurality of region cameras (300) installed in respective parking regions in the parking lot, and adapted to photograph a vehicle; a management server (400) comprising a vehicle license number recognition unit (450) for recognizing a vehicle license number on the basis of image data photographed by the entrance camera (100), the exit camera (200), and the region cameras (300), a registration unit (460) for registering a last photographed parking region on a parking ticket, which a driver holds when entering the parking lot, on the basis of a vehicle license number photographed by the region cameras installed in respective parking regions, a control unit (440) for calculating a number of available parking spaces for each parking region based on a last input vehicle license number for each parking region, and determining a total number of available parking spaces, and a guidance unit (470) for guiding an entering vehicle to an available parking region determined by the control unit through a parking guidance signal unit; and a display unit (350) installed at the entrance of the parking lot, and adapted to display the number of available parking spaces received from the control unit.

A plurality of embodiments for a parking management system according to the present invention are possible, and, hereinafter, only a preferred embodiment of the present invention will be described in detail with reference to the attached drawings.

FIG. 1 is a diagram showing a parking management system according to the present invention.

As shown in FIG. 1, a parking management system includes an entrance camera 100 installed at the entrance of a parking lot and adapted to photograph a vehicle that enters the entrance of the parking lot, an exit camera 200 for photographing a vehicle that departs from the parking lot, a plurality of region cameras 300 installed in respective parking regions in the parking lot, and adapted to photograph vehicles, a management server 400 for receiving a vehicle license number from image data photographed by the entrance camera, the exit camera, and the region cameras, determining whether the vehicle has entered the parking lot on the basis of vehicle information recognized by the entrance camera, and thus determining the path along which the vehicle moves, and the parking region in which the vehicle is parked, through the plurality of region cameras, a display unit 350 installed at the entrance of the parking lot and adapted to display the number of available parking spaces, received from the management server, and a parking guidance signal unit 500 for guiding an entering vehicle to an available parking region.

The entrance camera 100 is installed at the entrance of the parking lot, and is adapted to photograph a vehicle that enters the parking lot.

In this case, the entrance camera 100 transmits information about the license number of the vehicle, entering the parking lot, to the management server.

The parking management system may further include an entrance blocker, which is a means provided to block the entrance of a vehicle and is adapted to permit or block the entrance of the vehicle by performing an opening/closing operation in response to a control signal provided by the management server 400.

The exit camera 200 is installed at the exit of the parking lot and is adapted to photograph vehicles that depart from the parking lot.

The exit camera 200 photographs the license number of the vehicle, departing from the parking lot, and transmits the photographed image information to the management server 400.

The parking management system may further include an exit blocker, which is provided to block the departure of a vehicle and is adapted to permit or block the departure of the vehicle by performing an opening/closing operation in response to a control signal provided by the management server 400.

When a vehicle, registered to permit the entrance and departure thereof and stored in the storage unit, enters, the entrance or departure blocker is automatically opened or closed. When a bad vehicle stored in the storage unit enters, the opening/closing of the entrance or departure blocker is prevented, and a warning device is activated. When an unregistered vehicle, which is not stored in the storage unit, enters, a parking ticket is automatically issued without a parking ticket button being pressed.

The region cameras 300 are installed in respective parking regions in the parking lot on the basis of the path along which a vehicle moves, and are adapted to photograph the moving vehicle.

In this case, the region cameras 300 are cameras installed in respective regions in the parking lot, and are adapted to photograph a vehicle entering or departing from a corresponding parking region and to transmit the photographed image to the management server 400.

The entrance camera 100, the exit camera 200, and the region cameras 300 are implemented using infrared cameras to increase the recognition rate of license plates of vehicles, thus increasing the difference between the levels of the bright and dark portions of characters and the background of each license plate while preventing the reflection of light on the images acquired by the cameras.

Further, each of the region cameras 300 can be installed between respective parking regions to be paired with a respective parking guidance signal unit for guiding a vehicle to the closest parking region, which will be described later.

The management server 400 receives a vehicle license number from the image data photographed by the entrance camera 100, the exit camera 200, and the region cameras 300, determines whether the vehicle has entered the parking lot on the basis of vehicle information recognized by the entrance camera, and thus determines the path along which the vehicle moves, and the parking region in which the vehicle is parked, through the plurality of region cameras.

The management server 400 is described below with reference to FIG. 2.

FIG. 2 is a diagram showing the management server of the parking management system according to the present invention.

As shown in FIG. 2, the management server 400 includes a vehicle license number recognition unit 450 for receiving image data photographed by the entrance camera 100, the exit camera 200, and the region cameras 300, and recognizing a vehicle license number, a parking recognition unit 430 for recognizing the movement path of the vehicle through the plurality of region cameras, and determining the parking region in which the vehicle is parked on the basis of last recognized information, a registration unit 460 for registering a last photographed parking region on a parking ticket, which a driver holds when entering the parking lot, on the basis of the vehicle license number photographed by the region cameras installed in respective parking regions, a control unit 440 for calculating the number of available parking spaces for each parking region on the basis of the last input vehicle license number for each parking region, and the total number of available parking spaces, and a guidance unit 470 for guiding the vehicle, entering the parking lot, to an available region determined by the control unit through the parking guidance signal units.

First, the vehicle license number recognition unit 450 of the management server 400 may include a vehicle license number input unit 410 for receiving image data photographed by the entrance camera 100, the exit camera 200 and the region cameras 300, and receiving information about a vehicle license number, the time at which the vehicle enters the parking lot, etc., and a storage unit 420 for storing the information input through the vehicle license number input unit.

The vehicle license number recognition unit 450 receives an image obtained by the entrance camera 100 photographing a vehicle entering the parking lot through the entrance in the parking lot, and receives an image photographed by the exit camera 200 when the corresponding vehicle tries to depart from the parking lot through the exit of the parking lot.

The vehicle license number recognition unit 450 matches parking management data (date, entrance time, receipt serial number, etc.) with the recognized vehicle license number according to the corresponding vehicle license number, and transmits the matched results to the control unit 440.

The storage unit 420 stores therein information about an entering vehicle input through the entrance camera 100, and information about a departing vehicle input through the exit camera, and information calculated by the control unit 440, which will be described later, according to a parking space.

The parking recognition unit 430 recognizes the movement path of the vehicle through the plurality of region cameras, and determines the parking region in which the vehicle is parked on the basis of last recognized information.

The control unit 440 calculates the number of available parking spaces for each parking region on the basis of the last input vehicle license number for each parking region, and determines the total number of available spaces.

Further, the control unit 440 transmits a signal to the display unit 350 for displaying the number of available parking spaces so that the calculated vehicle information and information about parking spaces are displayed on the display unit 350, or outputs a signal to a parking fee management unit 250 to display fee information for a corresponding vehicle.

Further, the control unit 440 determines the remaining parking spaces for vehicles on the basis of the vehicle license number input from the entrance camera 100, and transmits information about the number of available parking spaces through a display unit 350 which is installed in the parking region and is adapted to display the number of parking spaces.

That is, the display unit 350 for displaying the number of parking spaces displays the current situation of the parking lot, provided by the management server 400, thus allowing the driver of a vehicle entering the parking lot to check the current situation and to more easily park the vehicle.

The registration unit 460 registers a last photographed parking region on a parking ticket, which the driver holds when entering the parking lot, on the basis of the vehicle license number photographed by the cameras installed in respective parking regions.

The registration unit 460 prints parking management data including a vehicle license number (date, entrance time, receipt serial number, etc.), for example, B3A100 (100-th space in an A-th row on a third basement level), on a parking ticket, and issues the parking ticket.

The guidance unit 470 guides the vehicle entering the parking lot to the available parking region determined by the control unit 440 through the parking guidance signal unit 500.

The parking management system may further include parking guidance signal units, each located between parking regions to be paired with a respective region camera, and each adapted to guide the vehicle to the closest parking region in which parking is possible along the path along which the vehicle to be parked will move, using the number of available parking spaces for each parking region received from the control unit 440.

When the entering vehicle is parked in a parking region guided by the parking guidance signal units, the parking management system prints the location at which the vehicle is parked, through a parking ticket output unit 260.

FIG. 3 is a flowchart showing a parking management method according to the present invention.

As shown in FIG. 3, in a method using the parking management system, the step S1 of determining whether photographed information about an entering vehicle has been received from the entrance camera is performed.

In this case, if the management server has not received image information about the entering vehicle from the entrance camera at step S1, a warning is generated, and the operation error is sensed at step S2, whereas if the image information about the entering vehicle has been received from the entrance camera, the step S3 of storing the information about the entering vehicle is performed.

The information about the entering vehicle input at step S3 includes a vehicle license number, the location of the vehicle, the time at which the vehicle enters the parking lot, etc., which are stored in the vehicle license number recognition unit.

The step S5 of the management server searching of available parking spaces using the information of the vehicle license number recognition unit is performed.

At step S5, the management server checks information about vehicles and the locations of the vehicles, which are stored in the vehicle license number recognition unit, and thus calculates the number of available parking spaces.

Next, the step S7 of the management server transmitting the number of available parking spaces for each parking region to the parking guidance signal units in order to notify the user of the number of available parking spaces is performed.

That is, at step S7, the control unit of the management server controls the parking guidance signal units, which are formed in respective parking regions, in order to indicate the closest parking region in which parking is possible for each parking region on the basis of the currently entering vehicle.

Next, the step S9 of the management server sensing whether the entering vehicle is parked in the guided parking region is performed.

In this case, when it is sensed that the entering vehicle is not parked in the parking region guided by the parking guidance signal units, the step S5 of calculating the number of available parking spaces is performed. When it is sensed that the entering vehicle is parked in the parking region guided by the parking guidance signal units, the step S11 of printing the location at which the vehicle is parked through the parking ticket output unit is performed.

Through the above procedure, the vehicle, entering the parking lot through the entrance thereof, can be promptly and conveniently parked.

Next, the step S13 of the management server determining whether image information photographed by the exit camera has been input is performed.

At this time, if it is determined that image information photographed by the exit camera has not been received at step S13, the management server continuously receives photographed information about an entering vehicle at step S1, whereas if it is determined that the photographed information has been received from the exit camera, the management server inquires about an entrance time, etc., using the license number of a vehicle departing from the parking lot at step S15.

In this case, if the entrance time of the departing vehicle is not stored in the storage unit as a result of the determination at step S15, the management server generates a warning at step S16, whereas if the entrance time corresponding to the license number of the departing vehicle is stored in the storage unit, the management server transmits corresponding data to the parking fee management unit at step S17.

FIG. 4 is a diagram showing an example of the utilization of a parking lot using the parking management system according to the present invention.

FIG. 4 illustrates a vehicle intended to be parked in a parking lot composed of a single floor or several floors and the system of the parking lot.

This parking lot includes nine parking regions 'A' to 'I', the entrance camera 100 and the display unit 350 are installed at the entrance of the parking lot, and the exit camera 200 and the parking fee management unit 250 are installed at the exit of the parking lot. Further, in each section, along the path along which the vehicle moves to the parking regions, a region camera 300 and a parking guidance signal unit 500 paired therewith are installed. Each of the parking guidance signal units 500 functions to guide the vehicle to the closest parking region in which parking is possible along the path along which the vehicle to be parked will move using the number of available parking spaces for each parking region, which has been received from the control unit 440. The region cameras 300 and the parking guidance signal units 500 can be installed to correspond to respective parking regions 'A' to 'I', or can be installed at respective locations at which the vehicle can change the movement direction thereof.

For example, when the vehicle enters the entrance of the parking lot, the entrance camera 100 photographs the license plate of the entering vehicle. Then, the vehicle license number recognition unit 450 recognizes and stores the license number of the vehicle. Further, the display unit 350 can display the total number of available parking spaces in which vehicles can be currently parked, and thus indicate that the vehicle can be parked.

When the management server 400 is intended to guide the vehicle to the parking region 'E' of the parking lot, the entering vehicle is guided to the parking region 'E' through the parking guidance signal units 500.

When the vehicle moves along paths 600, 601, and 602, the region camera corresponding to the parking region 'A', the region camera corresponding to the parking region 'B', and the region camera corresponding to the parking region 'E' sequentially photograph the vehicle, and can detect the movement path of the vehicle.

That is, the management server 400 can determine that the vehicle has been sequentially recognized by the entrance camera->the region camera corresponding to the parking region 'A'->the region camera corresponding to the parking region 'B'->the region camera corresponding to parking region 'E', and can consequently determine the movement path of the vehicle.

Further, if the movement of the vehicle is not recognized by the region cameras any more, the parking recognition unit 430 of the management server 400 determines that the vehicle has been parked in one of the spaces included in the parking region 'E'. Then, the control unit 440 subtracts 1 from the number of available parking spaces currently included in the parking region 'E', and also subtracts 1 from the total number of available parking spaces included in the parking lot, thus determining the number of available parking spaces.

Further, the control unit 440 displays the changed number of available parking spaces on the display unit 350, and differently operates the parking guidance signal units 500 to reflect the changed number of available parking spaces for each parking region.

Further, when the vehicle that entered the parking lot is parked in the parking region 'E', the parking ticket output unit prints the location at which the vehicle is parked on a parking ticket as the floor and parking region of the parking lot, thus allowing the driver to easily know the location at which the driver parks his or her vehicle through the parking ticket.

Here, if the parking ticket or the parking permit output from the parking ticket output unit is lost, the parking management system checks the entrance time of the vehicle at a kiosk, and thus enables payment for parking.

Further, when the corresponding vehicle license number is recognized by the exit camera of the parking lot, the management server 400 increases the number of available parking spaces in the parking region by 1, and indicates the location of parking using the parking guidance signal units 500 for guiding an entering vehicle to a parking region.

Meanwhile, the management server 400 can manage the movement paths and parking locations of respective vehicles even when a plurality of vehicles is simultaneously parking or moving.

In the parking management system, the registration unit is implemented to issue a parking ticket, that is, a parking permit, on which parking management data including a vehicle license number is printed. However, as other methods, a parking fee can be calculated on the basis of the times at which a vehicle is photographed, using the images photographed when the vehicle enters or departs from the parking lot, so that a parking fee can be charged without requiring parking tickets to be issued. Further, if a parking client inputs a vehicle license number to a kiosk, the last photographed vehicle image is displayed, and thus a parking fee is calculated.

That is, since the parking time is calculated using the photographed images, vehicles can enter or depart from the parking lot without receiving a parking ticket.

Further, the parking management system uses cameras to recognize vehicles, but can be implemented to recognize vehicles through a Radio Frequency Identification (RFID) unit, which is alternative to cameras, as another method.

Further, the parking management system can be implemented so that a separate camera for parking spaces and a rail formed on the ceiling of the parking lot are constructed in each parking region, so that the camera for parking spaces is attached to the rail to photograph respective parking spaces while moving along the corresponding region at regular intervals, and so that the number of available parking spaces is calculated on the basis of the photographed parking spaces to update image information about parked vehicles.

Hereinbefore, the parking management system according to the present invention has been described. It should be understood that the technical construction of the present invention can be implemented in other embodiments by those skilled in the art without changing the technical spirit or essential features of the present invention.

Accordingly, it should be understood that the above-described embodiments are only exemplary, but are not restrictive from any standpoint, that the scope of the present invention is defined by the accompanying claims, rather than the above detailed description, and that the meaning and scope of the claims and all changes and modifications derived from equivalents thereof should be interpreted as being included in the scope of the present invention.

BRIEF DESCRIPTION OF THE DRAWINGS

FIG. 1 is a diagram showing a parking management system according to the present invention;

FIG. 2 is a diagram showing the management server of the parking management system according to the present invention;

FIG. 3 is a flowchart showing a parking management method according to the present invention; and FIG. 4 is a diagram showing an example of the utilization of a parking lot using the parking management system of the present invention.

INDUSTRIAL APPLICABILITY

The above-described present invention is advantageous in that a system for managing and operating a parking lot is automated, so that vehicles entering or departing from the parking lot are automatically recognized, and the status of the parking lot is automatically monitored according to the automatic recognition while the status of parked vehicles is monitored in real time, thus reducing the time required for the vehicles to enter and depart from the parking lot, and consequently realizing the efficient management of the parking lot.

Further, the present invention is advantageous in that it determines that a vehicle has been parked in a parking region corresponding to the region camera that last recognized the vehicle, among a plurality of region cameras, thus allowing a driver to easily know the location at which his or her vehicle is parked.

Further, the present invention is advantageous in that parking guidance signal units, for guiding a vehicle to the closest available parking region along the path along which the vehicle to be parked will move, using the number of available parking spaces for each parking region, are formed, thus minimizing the time required to park the vehicle when the vehicle enters the parking lot.

The invention claimed is:

1. A parking management system, comprising: an entrance camera (100) installed at an entrance of a parking lot, and adapted to photograph a vehicle that enters the parking lot; an exit camera (200) for photographing a vehicle that departs from the parking lot; a plurality of region cameras (300) installed in respective parking regions in the parking lot, and adapted to photograph a vehicle; a management server (400) comprising a vehicle license number recognition unit (450) for recognizing a vehicle license number on the basis of image data photographed by the entrance camera (100), the exit camera (200), and the region cameras (300), a registration unit (460) for registering a last photographed parking region on a parking ticket, which a driver holds when entering the parking lot, on the basis of a vehicle license number photographed by the region cameras installed in respective parking regions, a control unit (440) for calculating a number of available parking spaces for each parking region based on a last input vehicle license number for each parking region, and determining a total number of available parking spaces, and a guidance unit (470) for guiding an entering vehicle to an available parking region determined by the control unit through a parking guidance signal unit; and a display unit (350) installed at the entrance of the parking lot, and adapted to display the number of available parking spaces received from the control unit.

2. The parking management system according to claim 1, further comprising at least one parking guidance signal unit (500) for guiding the vehicle to a closest available parking region in which parking is possible along a path along which the vehicle to be parked will move, using the number of available parking spaces for each parking region received from the control unit (440).

3. The parking management system according to claim 1, wherein the management server (400) further comprises a parking recognition unit (430) for determining that the vehicle has been parked in a parking region corresponding to a region camera that last recognized the vehicle among the region cameras (300).

4. A parking management system, comprising: an entrance camera (100) installed at an entrance of a parking lot, and adapted to photograph a vehicle that enters the parking lot; a parking fee management unit (250) for displaying an overall parking time and parking fee of a vehicle that enters or departs from the parking lot, and indicating departure of the vehicle; a plurality of region cameras (300) installed in respective parking regions in the parking lot, and adapted to photograph a vehicle; a management server (400) comprising a vehicle license number recognition unit (450) for recognizing a vehicle license number on the basis of image data photographed by the entrance camera (100), an exit camera (200), and the region cameras (300), a registration unit (460) for registering a last photographed parking region on a parking ticket, which a driver holds when entering the parking lot, on the basis of a vehicle license number photographed by the region cameras installed in respective parking regions, a control unit (440) for calculating a number of available parking spaces for each parking region on the basis of a last input vehicle license number for each parking region, and determining a total number of available parking spaces, and a guidance unit (470) for guiding an entering vehicle to an available parking region determined by the control unit through a parking guidance signal unit; and a display unit (350) installed at the entrance of the parking lot, and adapted to display the number of available parking spaces received from the control unit.

5. The parking management system according to claim 1, further comprising a Radio Frequency Identification (RFID) unit for recognizing entrance and departure of a vehicle instead of the cameras for recognizing the entrance and departure of the vehicle.

6. The parking management system according to claim 1, wherein the parking management system is operated to sense whether an entering vehicle is a vehicle permitted to enter the parking lot on the basis of an image photographed when the vehicle enters the parking lot, thus allowing the vehicle to enter the parking lot without receiving a separately issued parking ticket.

* * * * *